US006095513A

United States Patent [19]

Wright et al.

[11] Patent Number: 6,095,513

[45] Date of Patent: Aug. 1, 2000

[54] HI-SPEED SHEET FEEDER

[75] Inventors: William J Wright, Killingworth; Karel Janatka, Southbury; Robert J. Allen, Danbury, all of Conn.

[73] Assignee: Pitney Bowes Inc., Stamford, Conn.

[21] Appl. No.: 09/212,935

[22] Filed: Dec. 16, 1998

[51] Int. Cl.[7] ..... B65H 3/12

[52] U.S. Cl. ..... 271/94; 271/99; 271/104; 271/108; 271/161

[58] Field of Search ..... 271/94, 99, 104, 271/108, 161, 276, 311, 312

[56] References Cited

U.S. PATENT DOCUMENTS

| | | | |
|---|---|---|---|
| 2,812,178 | 11/1957 | Hagren | 271/104 X |
| 2,862,709 | 12/1958 | Labombarde | 271/99 X |
| 4,269,405 | 5/1981 | Mitzel | 271/94 |
| 4,320,893 | 3/1982 | Blumle | 271/94 |
| 4,579,330 | 4/1986 | Lehmann | 271/11 |
| 4,787,619 | 11/1988 | Fuss et al. | 271/98 |
| 5,072,922 | 12/1991 | Paulson | 271/11 |
| 5,088,717 | 2/1992 | Hamanaka et al. | 271/98 |
| 5,642,878 | 7/1997 | Smithe et al. | 271/109 |

*Primary Examiner*—David H. Bollinger
*Attorney, Agent, or Firm*—Christopher J. Capelli; Michael E. Melton

[57] ABSTRACT

A sheet feeder for feeding sheets from a sheet stack, having a feed deck for supporting the sheet stack and a pair of spaced apart parallel guide rails on the feed deck for receiving the sheet stack between the guide rails. A sheet feeding assembly is mounted in proximity to a sheet feeding end of the feed deck and is operative to feed individual lowermost sheets from the sheet stack, the sheet feeding assembly including a continuously rotating feed drum having an inner and outer circumference and a plurality of suction openings and a vacuum assembly received in the inner circumference of the feed drum and having at least one rotating cylinder coupled to a vacuum source and movable between an actuated position for drawing air downward through the portion of the feed drum extending above the planar surface of the feed deck and a default position preventing the drawing of air through the feed drum when a vacuum is applied to the at least one rotating cylinder.

20 Claims, 10 Drawing Sheets

102
108
166
168
137
110
104
106
142
112
114
130
120
146
148
124
116
150
118
122
134
126
144
128
107
161
157
159
155
101
214
202
138
4
4

HI-SPEED SHEET FEEDER

FIELD OF THE INVENTION

The present invention relates generally to devices for feeding individual sheets from the bottom of a sheet stack, and more particularly, to a sheet feeder having a pneumatic vacuum assembly for feeding individual sheets from the bottom of a sheet stack.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation.

For example, a typical inserter system includes a plurality of serially arranged stations including a sheet feeding station, a folding station, a plurality of insert feeder stations, an envelope feeder and insertion station and an output station for collecting the assembled mailpieces. As is conventional, the sheet feeder feeds one or a plurality of sheets to an accumulating station, which collects the fed sheets into a predefined collation packet. This collation is then preferably advanced to a folding station for folding the collation. Thereafter, the serially arranged insert feeder stations sequentially feed the necessary documents onto a transport deck at each insert station as the folded collation arrives at the respective station to form a precisely collated stack of documents which is transported to the envelope feeder-insert station where the stack is inserted into the envelope. The finished envelope is then conveyed to an output station for distribution into the mail stream. A typical modem inserter system also includes a control system to synchronize the operation of the overall inserter system to ensure that the mailpieces are properly assembled.

Aside from reliability, one of the most important features of a modem inserter system is speed. Speed is defined as how many mailpieces can be assembled in a given time period. For instance it is known to process up to twelve thousand (12,000) mailpieces each hour, where each mailpiece consists of a three (3) page folded collation and at least one insert. However, speeds much higher than his rate are extremely difficult because current sheet feeders are unable to reliably feed sheets at such high speeds.

Such a known sheet feeder can be found in U.S. Pat. Nos. 4,579,330 and 4,787,619, both of which are assigned to Mathias Bauerle GmbH of the Federal Republic of Germany. In brief, this is a pneumatic sheet feeder that removes individual sheets from a stack. The sheet feeder includes a table having a surface for supporting a stack of sheets. A pair of parallel guide rails are provided on the table and with facing surfaces so that the stack is confined between the guide rails for movement in a feed direction across the table. Blast nozzles are provided in the guide rails for blowing air against the stack to form an air cushion between lower sheets of the stack. A suction cylinder is rotatably mounted to the table and includes a suction chamber therein for receiving a vacuum. Radial openings in the suction chamber cause a suction induced adhesion of a leading edge of a lowermost feed in the stack so that with rotation of the cylinder, the lowermost sheet is fed in the feed direction away from the rest of the stack.

In use, this sheet feeder has proven reliably when operating at speeds up to approximately 35,000 sheets per hour. The aforementioned sheet feeder is unable to operate at speeds greater than this rate because of its limited speed in the vacuum valve system and in the velocity of its outer feed drum.

Thus, it is an object of the present invention to provide an improved sheet feeder that operates to reliably feed sheets at speeds in excess of that which is capable by the above described prior art sheet feeder.

SUMMARY OF THE INVENTION

Accordingly, the present invention relates to a sheet feeding device operative to feeds sheets at high speeds and thus overcome the shortcomings of the aforesaid prior art.

Briefly, the present invention relates to a sheet feeder for feeding individual sheets from a sheet stack having a feed deck for supporting the sheet stack with a pair of spaced apart parallel guide rails for receiving the sheet stack therebetween. An elongate opening is formed in the feed deck wherein a feed drum having an inner and outer circumference is rotatably mounted such that a portion of its outer circumference extends above the feed deck.

A mounting assembly is pivotally supported above the feed deck and is movable between an open and closed position. The mounting assembly includes a stripper blade extending downward toward the feed deck such that when the mounting block is in its closed position a lower end portion of the stripper blade is spaced from the outer circumference of the feed drum at a distance substantially equal to a thickness of a sheet to be fed from the sheet stack. And when positioned in its open position, the lower end of the stripper blade is caused to pivot away from the feed deck such that the pivot path of the lower end of the stripper blade does not intersect with a plane in which the sheet stack resides on the feed deck The mounting assembly further includes at least one rotatable roller extending downward from the mounting block such the when the mounting block is positioned in its closed position the at lease one rotatable roller is caused to bias against the outer circumference of the feed drum and is in close proximity to the downstream end of the elongate opening of the feed deck.

Preferably, a portion of the outer circumference of the feed drum is provided with a recessed portion and the lower end of the stripper blade is configured to have a correspondingly configured triangular configuration dimensioned to partially receive within the recessed portion of the feed drum.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
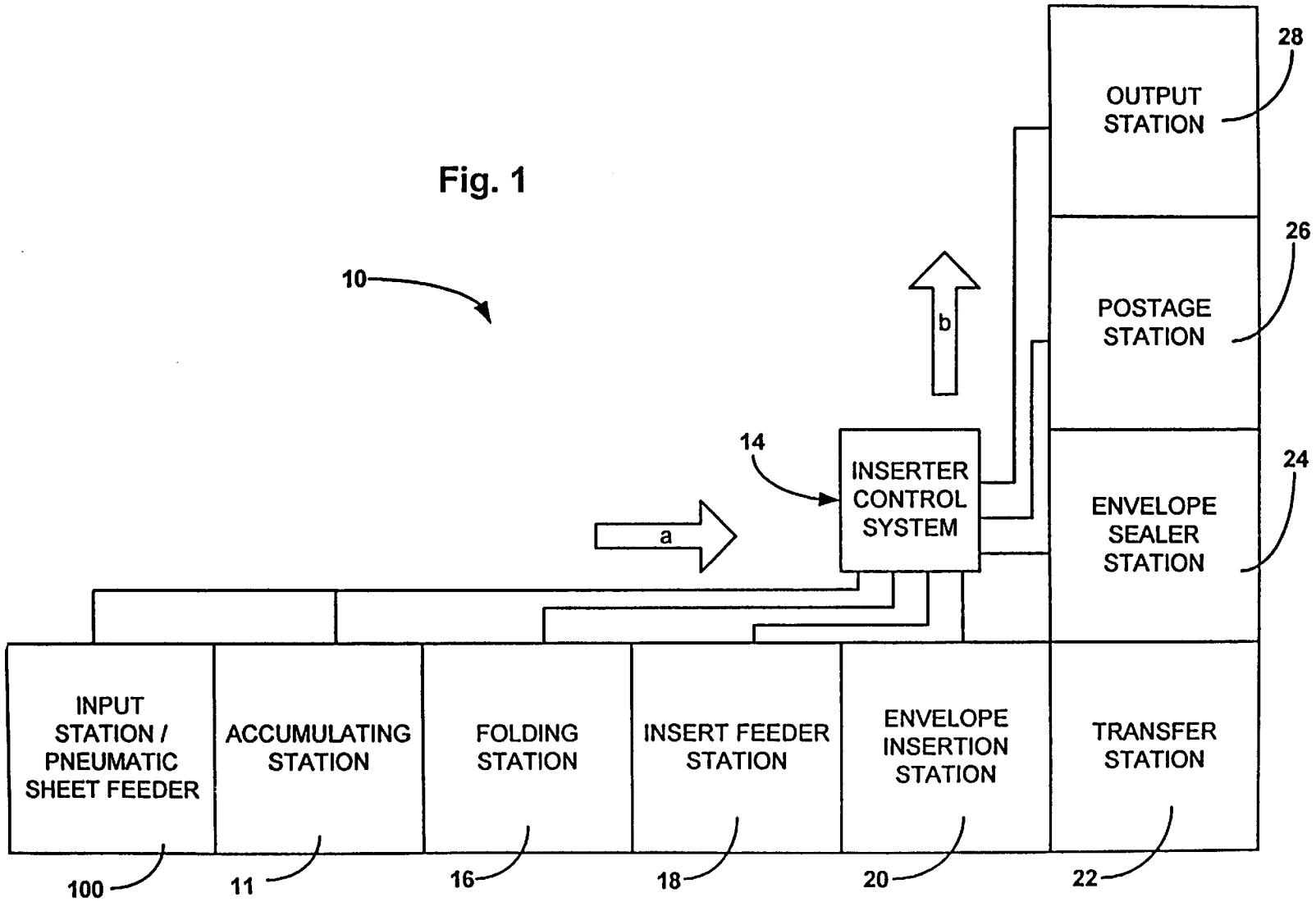
FIG. 1 is a block diagram of a document inserting system in which the present invention is incorporated.

In describing the preferred embodiment of the present invention, reference is made to the drawings, wherein there is seen in FIG. 1 a schematic of a typical document inserting system, generally designated 10. A brief description of this typical inserting system 10 is given to set forth the operating environment for the present invention pneumatic sheet feeder, generally designated 100 in FIGS. 1 and 2.

In the following description, numerous paper handling stations implemented in a typically prior art inserter system 10 are set forth to provide a brief understanding of a typical inserter system. It is of course apparent to one skilled in the art that the present invention may be practiced without the specific details in regards to each of these paper-handling stations of inserter system 10.

As will be described in greater detail below, document inserter system 10 preferably includes an input station 100 that feeds paper sheets from a paper web to an accumulating station 11 that accumulates the sheets of paper in collation packets. Preferably, only a single sheet of a collation is coded (the control document), which coded information enables the control system 14 of inserter system 10 to control the processing of documents in the various stations of the mass mailing inserter system. The code can comprise a bar code, UPC code or the like.

Essentially, input station 100 feeds sheets in a paper path, as indicated by arrow "a," along what is commonly termed the "deck" of inserter system 10. After sheets are accumulated into collations by an accumulating station 11, the collations are folded in folding station 16 and the folded collations are then conveyed to a insert feeder station 18. An example of such an accumulating station 11 can be found in U.S. Pat. No. 5,083,769, which is hereby incorporated by reference. It is to be appreciated that a typical inserter system 10 includes a plurality of insert feeder stations, but for clarity of illustration only a single insert feeder 18 is shown.

Insert feeder station 18 is operational to convey an insert (e.g., an advertisement) from a supply tray to the main deck of inserter system 10 so as to be nested with the aforesaid sheet collation conveying along the main deck. The sheet collation, along with the nested insert(s), are next conveyed to an envelope insertion station 20 that is operative to insert the collation into an open envelope. Afterwards, the stuffed envelope is then preferably conveyed to a transfer module station 22.

The transfer module 22 changes the direction of motion of flat articles (e.g., envelopes) from a first path (as indicated by arrow "a") to a second path (as indicated by arrow "b"). In other words, transfer module 22 takes a stuffed envelope from the envelope insertion station 20 and changes its direction of travel by ninety degrees (90°). Hence, transfer module 10 is commonly referred to in the art as a "right-angle transfer module".

After the envelope changes its travel direction, via transfer module 22, it is then preferably conveyed to an envelope sealer station 24 for sealing. After the envelope is sealed, it is then preferably conveyed to a postage station 26 having at least one postage meter for affixing appropriate postage to the envelope. Finally, the envelope is preferably conveyed to an output station 28 that collects the envelopes for postal distribution.

As previously mentioned, inserter system 10 also includes a control system 14 preferably coupled to each modular station of inserter system 10, which control system 14 controls and harmonizes operation of the various modular stations implemented in inserter system 10. As an example of such a control system can be found in commonly assigned U.S. Pat. Nos.: 3,935,429; 4,527,791; 4,568,072; 5,345,547; 5,448,490 and 5,027,279, which are all hereby incorporated by reference in their entirety. Preferably, control system 14 uses an Optical Marking Reader (OMR) for reading the code from each coded document.

It is to be appreciated that the depicted embodiment of a typically prior art inserter system 10 is only to be understood as an exemplary configuration of such an inserter system. It is of course to be understood that such an inserter system may have many other configurations in accordance with a user's specific requirements.

Figure 2:
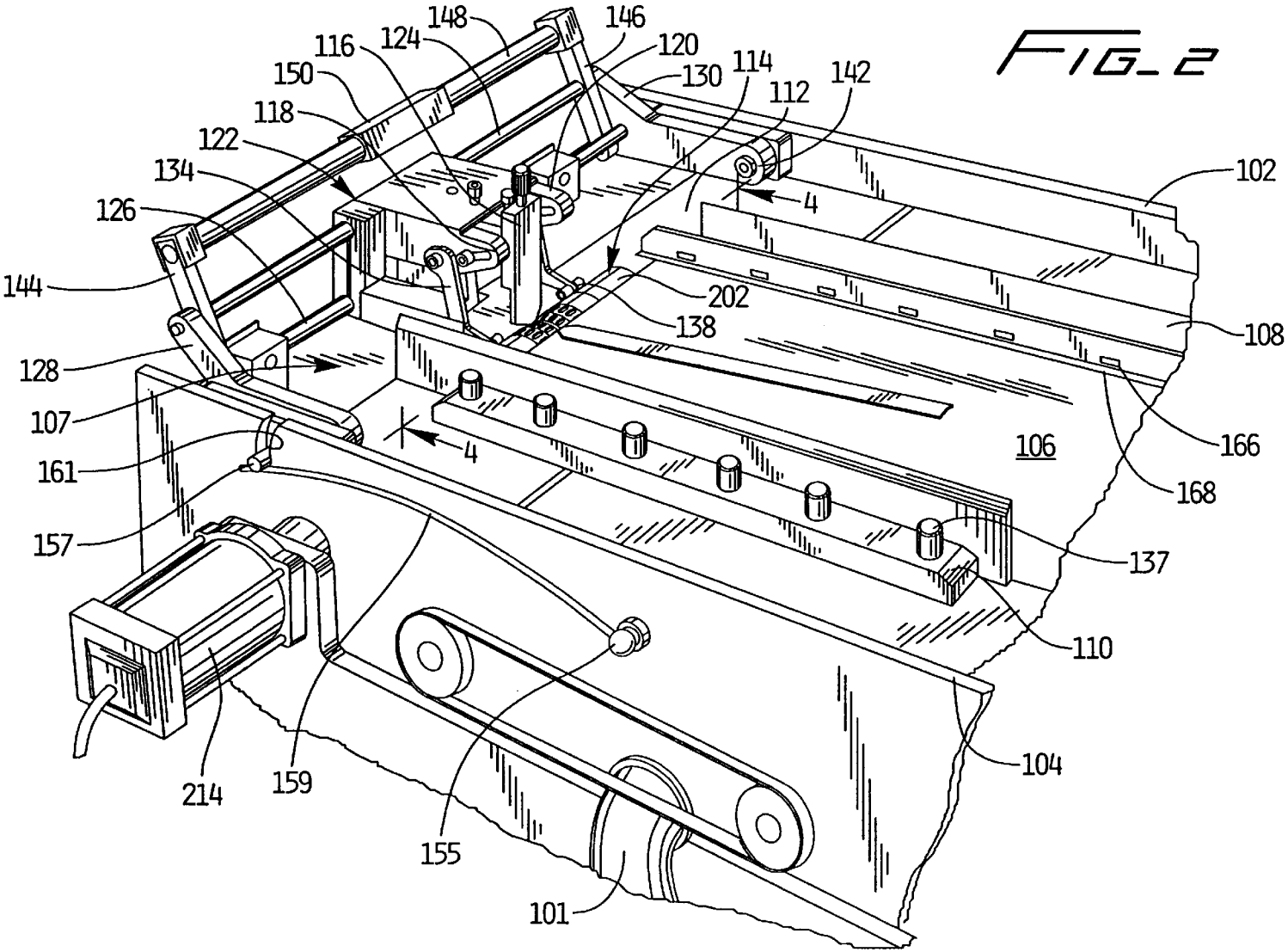
FIG. 2 is a perspective view of the upper portion of the present invention pneumatic sheet feeder.
Figure 5:
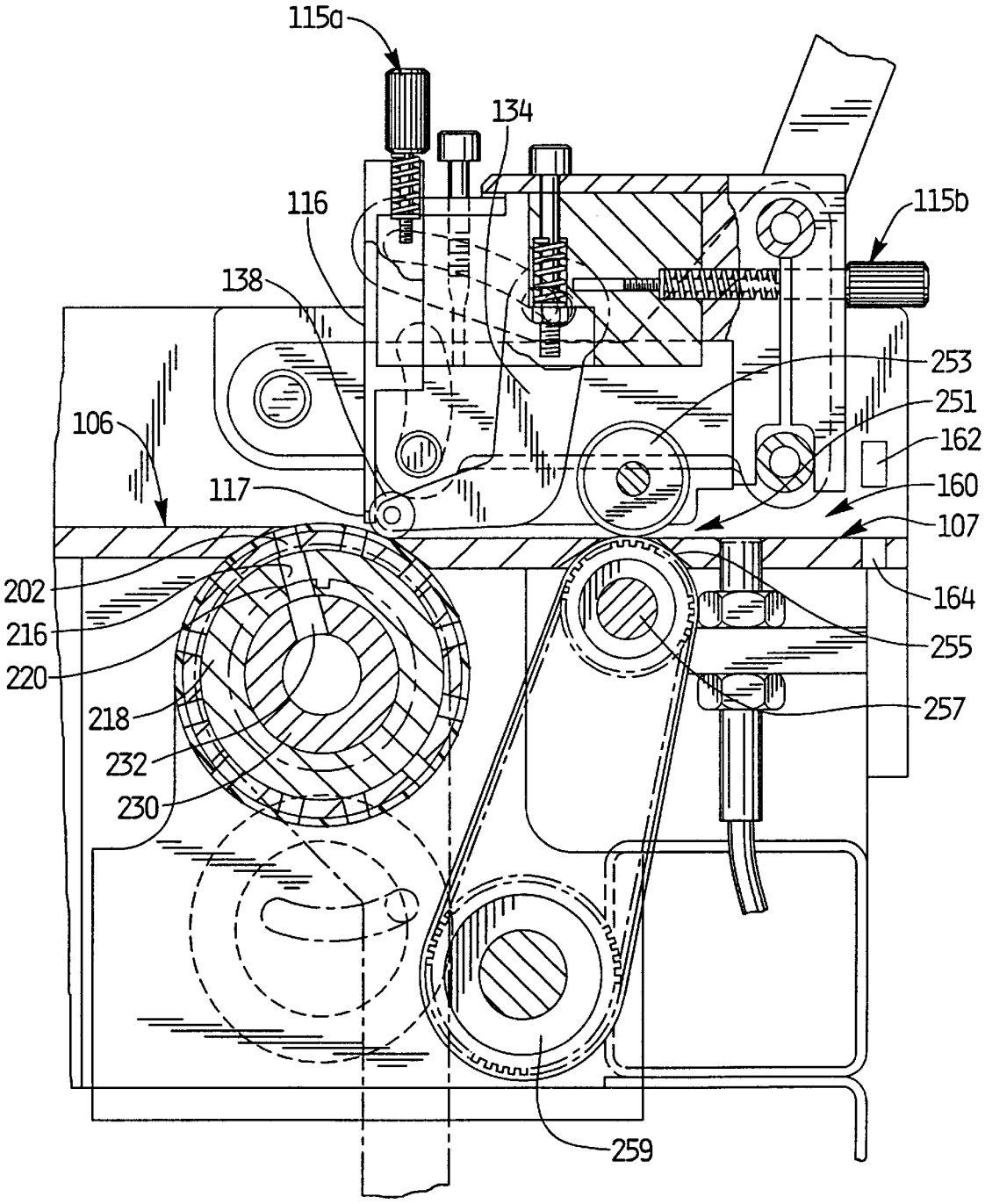
FIG. 5 is a cross-sectional view taken along line 5—5 of FIG. 4.

Referring now specifically to the sheet feeder 100 of the present invention, as best shown in FIG. 2, sheet feeder 100 includes a base frame having opposing side portions 102 and 104. A planar deck surface 106 is positioned and supported intermediate the base side portions 102 and 104. On the deck surface 106 are positioned two sheet guide rails 108, 110 that extend parallel to each other and are preferably displaceable transversely relative to each other by known means. An open slot 112 is formed on the deck 106 in which a pneumatic cylinder assembly 114 is mounted for rotation within and below a stripper plate 116 extending generally parallel with the cylinder assembly 114. The pneumatic cylinder assembly 114 includes an outer feed drum 202 that is mounted so that its top outer surface portion is substantially tangential to the top surface of the feed deck 106 and takeaway deck 107, which takeaway deck 107 is located downstream of the feed drum 202 (as best shown in FIG. 5). A more detailed description of the pneumatic cylinder assembly 114 and its operation will be provided further below.

With reference to FIG. 5, it can be seen that the outer circumference of the feed drum 202 extends between the open slot 112 formed between the angled ends of the two decks 106 and 107. The respective facing ends of the feed deck 106 and takeaway deck 107 are dimensioned (e.g., angled) so as to accommodate the outer circumference of the feed drum 202. The top portion of the outer circumference of the feed drum 202 extends above the top surfaces of both decks 106 and 107, wherein the top surface of the takeaway deck 107 resides in a plane slightly below the plane of the top surface of the feed deck 106. Preferably the takeaway deck 107 resides in a plane approximately one tenth of an inch (0.100") below the top planar surface of the feed deck 106. This difference in deck heights is chosen so as to minimize the angular distance the sheets have to travel around the feed drum 202 when feeding from the feed deck 106. By reducing this angular distance, the amount of "tail kick" associated with sheets being fed by the feed drum 202 is reduced. "Tail kick" can best be defined as the amount the trail edge of a sheet raises off the feed deck 106 as it leaves the feed drum 202. It is to be understood that "tail kick" is a function of sheet stiffness and the angle of takeaway as determined by the respective heights of the feed drum 202 and takeaway deck 107.

The stripper plate 116 is adjustably fixed between two mounting extensions 118, 120 extending from a mounting block 122. A first set screw 115*a* is received in a threaded opening in the top of the mounting block 122 for providing vertical adjustment of the stripper blade 116 relative to the deck 106 of the sheet feeder 100. A second set screw 1115*b* is received in a threaded opening in the back of the mounting block 122 for providing lateral adjustment of the stripper blade 116 relative to the feed deck 106 of the sheet feeder 100.

As will be appreciated further below, the stripper blade 116 allows only one sheet to be fed at a time by creating a feed gap relative to the outer circumference of the feed drum 202, which feed gap is approximately equal to the thickness of a sheet to be fed from a sheet stack. In particular, the lower geometry of the stripper blade 116 is triangular wherein the lower triangular vertex 117 of the stripper blade 116 is approximately located at the center portion of the sheets disposed on the deck 106 as well as the center of the rotating feed drum 202. An advantage of the triangular configuration of the lower vertex 117 of the stripper blade 116 is that the linear decrease in the surface area of stripper blade 116 at its lower vertex 117 provides for reduced friction which in turn facilitates the feeding of sheets beneath the lower vertex 117 of the stripper blade 116. Preferably, it is at this region just beneath the lower vertex 117 of the stripper blade 116 in which resides a metal band 210 positioned around the outer circumference of the feed drum 202, (and preferably in the center portion of the feed drum 202) which metal band 210 acts as a reference surface for the position of the lower vertex of the stripper blade 116 to be set in regards to the feed drum 202. This is particularly advantageous because with the hard surface of the metal band 210 acts as a reference, a constant feed gap between the lower vertex 117 of the stripper blade 116 and the feed drum 202 is maintained.

Figure 3:
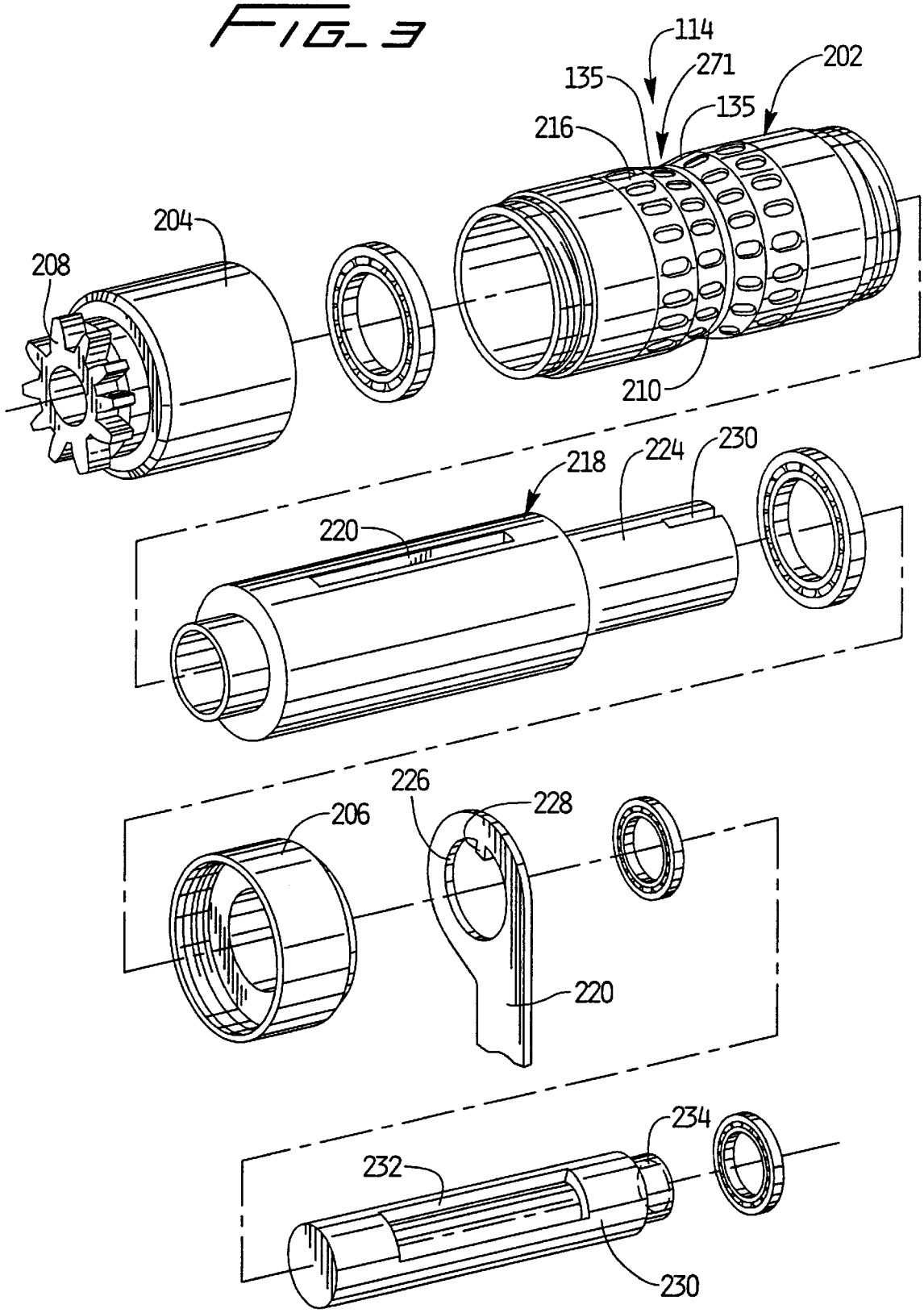
FIG. 3 is a perspective exploded view of the pneumatic cylinder assembly of the sheet feeder of FIG. 2.

With continuing reference to FIG. 3 the center portion of the feed drum 202 is provided with a recessed portion 271 preferably in a triangular configuration dimensioned to accommodate the lower triangular vertex 117 of the stripper blade 116. Thus, the stripper blade 116 is positioned such that its lower triangular vertex 117 resides slightly above the recessed portion 271 of the feed drum 202 and is preferably separated therefrom at a distance substantially equal to the thickness of a sheet to be fed from a sheet stack residing on the feed deck 106 of the sheet feeder 100. As can also be seen in FIG. 2, the metal band 210 is preferably located in the lower vertex of the of the recessed portion 271 formed in the outer circumference of the feed drum 202. It is to be appreciated that an advantage of this formation of the recessed portion 271 in the feed drum 202 is advantageous because it facilitates the separation of the lower most sheets (by causing deformation in the center portion of that sheet) from the sheet stack residing on the deck 106 of the sheet feeder 100.

Figure 8:
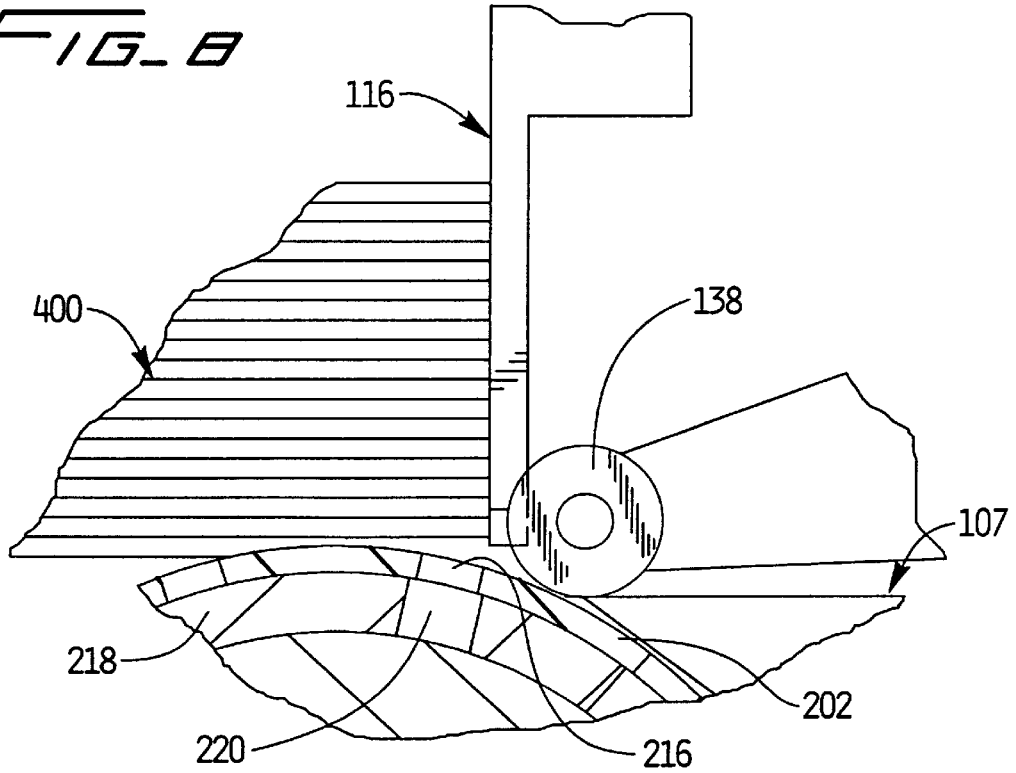
FIG. 8 is a partial enlarged view of FIG. 7.
Figure 9:
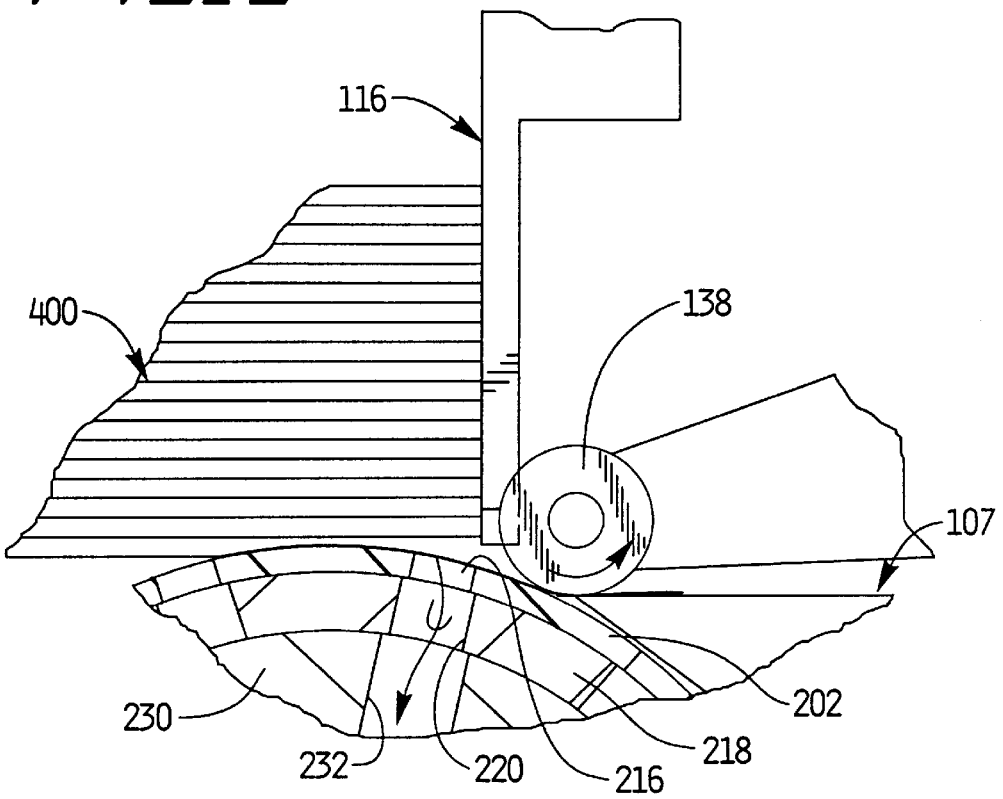
FIGS. 9–10 are partial enlarged views of FIG. 7 depicting a sheet feeding through the sheet feeder assembly of FIG. 2.

Also extending from the mounting block 122 are two drive nip arms 134, 136 each having one end affixed to the mounting block 122 while the other end of each opposing arm 134, 136 is rotatably connected to a respective "takeaway" nip 138. Each takeaway nip 138 is preferably biased against the other circumference of the vacuum drum 118 at a position that is preferably downstream of the stripper blade 116 relative to the sheet flow direction as indicted by arrow "a" on the feed deck 106 of FIG. 1. It is to be appreciated that when sheets are being fed from the feed deck 106, each individual sheet is firmly held against the rotating feed drum 202 (as will be further discussed below). And when the sheets are removed from the feed drum 106, as best seen in FIGS. 8 and 9, the end portion of the takeaway deck 107 is provided with a plurality of projections or "stripper fingers" 133 that fit closely within corresponding radial grooves 135 formed around the outer circumference of the feed drum 202 so as to remove individual sheets from the vacuum of the feed drum 202 as the sheets are conveyed onto the takeaway deck 107. That is, when the leading edge of a sheet is caused to adhere downward onto the feed drum 202 (due do an applied vacuum, as discussed further below), the sheet is advanced by the rotation of the feed drum 202 from the feed deck 106 until the leading edge of the sheet rides over the stripper fingers 133. The stripper fingers 133 then remove (e.g., "peel") the sheet from the outer vacuum surface of the feed drum 202. Thereafter, immediately after each sheet passes over the stripper fingers 133 so as to cause that portion of the sheet conveying over the stripper fingers 133 to be removed from the vacuum force effected by outer surface of the feed drum 202, that portion of the sheet then next enters into the drive nip formed between the takeaway nips 138 and the outer surface of the feed drum 202, which nip provides drive to the sheet so as to ensure no loss of drive upon the sheets after its vacuum connection to the feed drum is terminated..

Regarding the takeaway nips 138, and as just stated, they collectively provide positive drive to each sheet that has advanced beyond the stripper fingers 133. It is noted that when sheets are advanced beyond the stripper fingers 133, the vacuum of the feed drum 202 is no longer effective for providing drive to those sheets. As such, the takeaway nips 138 are positioned slightly beyond the feed drum 202 and in close proximity to the downstream portion of the stripper fingers 133 as possible. It is noted that due the limited space in the region near the stripper fingers 133 and the takeaway deck 107, it is thus advantageous for the takeaway nips 138 to have a small profile. Preferably, the takeaway nips 138 are radial bearings having a ⅜" diameter.

Figure 4:
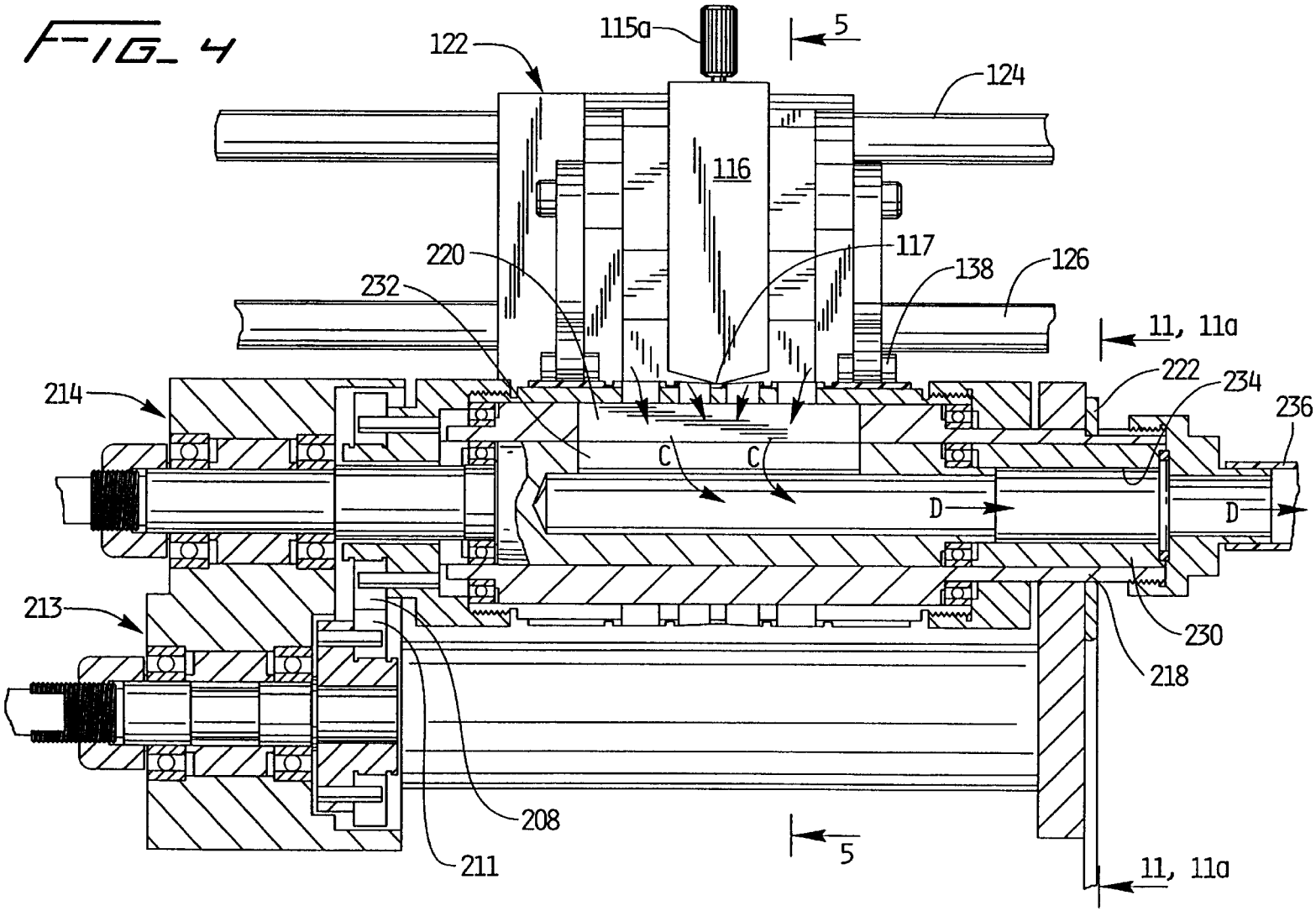
FIG. 4 is a cross-sectional view taken along line 4—4 of FIG. 2.

With reference to FIGS. 1, 4 and 5, the mounting block 122 extends from upper and lower mounting shafts 124 and 126, wherein the lower shaft 126 extends through the mounting block 122 and has it opposing ends affixed respectively in pivoting arm members 128 and 130. Each pivoting arm member 128 and 130 has a respective end mounted to each side portion 102 and 104 of feeder 100 about a pivoting shaft 142. The other end of each pivoting arm member 128 and 130 has a respective swing arm 144, 146 pivotally connected thereto, wherein the pivot point of each swing arm 144, 146 is about the respective ends of upper shaft 124, which shaft 124 also extends through the mounting bock 122. A handle shaft 148 extends between the upper ends of the swing arms 144 and 146, wherein a handle member 150 is mounted on an intermediate portion of the handle shaft 148.

Figure 6:
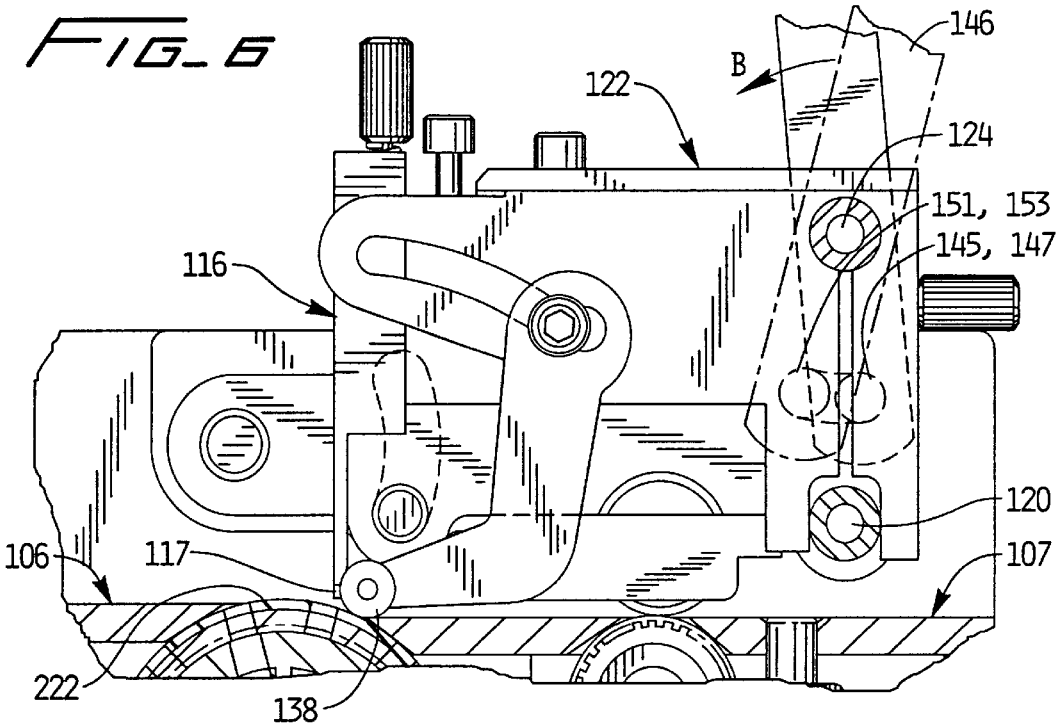
FIGS. 6 and 6*a* are partial side views of the sheet feeder of FIG. 2 depicting the mounting block in closed and open positions.
Figure 6A:
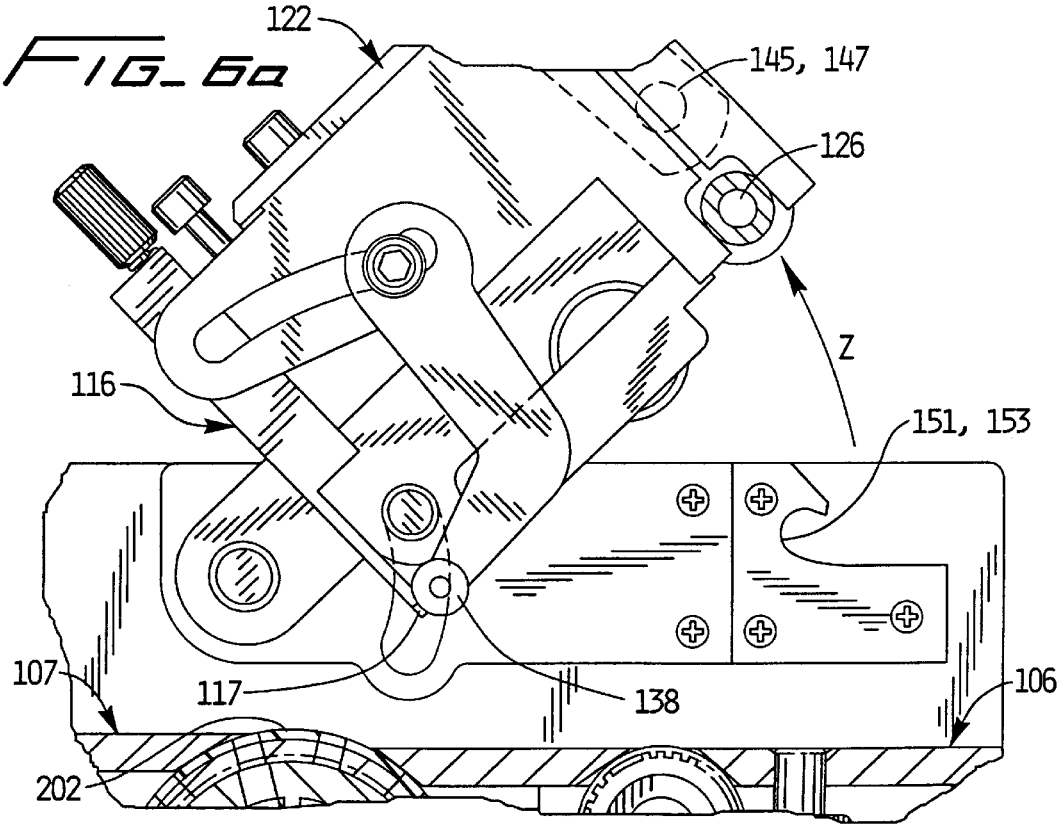

In order to facilitate the pivoting movement of the mounting block 122, and as is best shown if FIGS. 6 and 6*a,* the lower end portion of each swing arm 144, 146 is provided with a locking shaft 145, 147 that slideably extends through a grooved cutout portion (not shown) formed in the lower end portion of each pivoting arm member 128 and 130, wherein each locking shaft 145, 146 slideably receives in a grooved latch 151, 153 provided on each side 102, 104 of the sheet feeder 100 adjacent each pivoting arm member 128, 130. When each locking shaft 145, 147 is received in each respective grooved latch 151, 153, the mounting block 122 is positioned in a closed or locked positioned as shown in FIGS. 2 and 6. Conversely, when the locking shafts 145, 147 are caused to be pivoted out of their respective grooved latch 151, 153 (via pivoting movement of the two swing arms 144,146), the mounting block 122 is caused to pivot upward and away from the deck 106 as is shown in FIG. 6*a*. As also shown in FIG. 6*a,* when the mounting block 122 is caused to be pivoted to its open position (FIG. 6*a*), the stripper blade 116 moves along a radial path (as indicated by arrow "z") so as not to intersect with the sheet stack 400 disposed on the deck 106 of the sheet feeder 100. This is particularly advantageous because when the mounting block 122 is caused to be moved to its open position (FIG. 6*a*), the sheet stack disposed on the feed deck need not be interrupted.

Providing an upward biasing force upon preferably one of the pivoting arm members 128, 130 (and in turn the mounting block 122) is an elongated spring bar 159 mounted on the outside surface of one of the side portions 104 of the sheet feeder 100. In particular, one of the ends of the spring bar 159 is affixed to a mounting projection 155 extending from the side 104 of the sheet feeder 100 wherein the other end of the spring bar 159 is caused to upwardly bias against an end portion of a spring shaft 157 extending from one of the swing arms 128 when the mounting block 122 is positioned in its closed position (FIG. 2) as mentioned above. The spring shaft 157 extends through a grooved cutout 161 formed in a side portion 104 of the sheet feeder 100 wherein the other end of the spring shaft 157 extends from one of the pivoting arm members 128. Thus, when the locking shafts 145, 147 are caused to be pivoted out of their respective grooved latch 151, 153 (via pivoting movement of the two swing arms 144, 146), the upwardly biasing force of the spring bar 159 causes the swing arms 128 to move upward, which in turn causes the mounting block 122 to pivot upward and away from the deck 106 as is shown in FIG. 6*a* due to the biasing force of the spring bar 159.

It is to be appreciated that the mounting block 122 pivots upward and away from the deck 106, and in particular the vacuum drum assembly 114 so as to provide access to the outer surface portion of the outer drum 138 for maintenance and jam access clearance purposes. With continuing reference to FIG. 1 and with reference to FIGS. 6 and 6*a,* this is effected by having the operator pivot the handle portion 150, about shaft 124, towards to deck 106 (in the direction of arrow "b" in FIG. 6*a*), which in turn causes the pivoting arm members 128 and 130 to pivot upward about respective shafts 142, which in turn causes corresponding upward pivoting movement of the mounting block 122 away from the deck 106 of the sheet feeder 106. Corresponding upward pivoting movement is effected on the mounting block 122 by pivoting arm members 128 and 130 due to that shafts 124 and 126 extend through the mounting block 122, wherein the ends are affixed in respective swing arms 144 and 146, which are respectively connected to pivoting arm members 128 and 130.

As shown in FIG. 5, downstream of the drive nips 138 is provided an electronic sensor switch 160 in the form of a light barrier having a light source 162 and a photoelectric 164. The electronic sensor switch 160 is coupled to the inserter control system 14 (FIG. 1) and as will be discussed further below detects the presence of sheets being fed from the sheet feeder 100 so as to control its operation thereof in accordance with a "mail run job" as prescribed in the inserter control system 14. Also provided downstream of the dive nips 138 is preferably a double detect sensor (not shown) coupled to the control system 14 and being operative to detect for the presence of fed overlapped sheets for indicating an improper feed by the sheet feeder 100.

With reference to FIG. 5, sheet feeder 100 is provided with a positive drive nip assembly 251 located downstream of the takeaway nips 138 and preferably inline with the center axis of the takeaway deck 107 (which corresponds to the center of the feed drum 202). The drive nip assembly 251 includes an idler roller 253 extending from the bottom portion of the mounting block 122 which provides a normal force against a continuously running drive belt 255 extending from a cutout provided in the takeaway deck 107. The drive belt 255 wraps around a first pulley 257 rotatably mounted below the takeaway deck 207 and a second pulley 259 mounted within the sheet feeder 100. The second pulley 259 is provided with a gear that intermeshes with a gear provided on motor 213 for providing drive to the drive belt 255. Preferably, and as will be further discussed below, motor 213 provides constant drive to the drive belt 213 wherein the drive nip 251 formed between the idler roller 253 and drive belt 255 on the surface of takeaway deck 207 rotates at a speed substantially equal to the rotational speed of the feed drum 202 (due to the feed drums 202 connection to motor 213). Thus, the drive nip assembly 251 is operational to provide positive drive to a sheet when it is downstream of the takeaway nips 138 at a speed equal, or preferably slightly greater (due to gearing), than the rotational speed of the feed drum 202.

With returning reference to FIG. 2, the side guide rails 108 and 110 are preferably spaced apart from one another at a distance approximately equal to the width of sheets to be fed from the deck 106 of the sheet feeder 100. Each side guide rail 108,110 is provided with a plurality spaced apart air nozzles 166, each nozzle 166 preferably having their orifice positioned slightly above thin strips 168 extending along rails 108 and 110 on the top surface of the feed deck 106. The air nozzles 166 are arranged on the inside surfaces of the guide rails 108 and 110 facing each other of rails 108 and 110, which are provided with valves (not shown) that can be closed completely or partly through manually actuated knobs 37. It is to be understood that each rail 108 and 110 is connected to an air source (not shown), via hose 101, is configured to provide blown air to each air nozzle 166.

Referring now to the pneumatic cylinder assembly 114, and with reference to FIGS. 2–5, the pneumatic cylinder assembly 214 includes the feed drum 202 having opposing end caps 204, 206. Each end cap 204, 206 is preferably threadingly engaged to the end portions of the feed drum 202 wherein the end of one of the end caps 204 is provided with a gear arrangement 208 for providing drive to the feed drum 202. Preferably the gear 208 of the end cap 204 inter-meshes with a gear 211 associated with an electric motor 213 mounted on the side 104 of the sheet feeder 100 for providing drive to the feed drum 202. Positioned between the end caps 204, 206 and the outer surface of the feed drum 202 are metal bands 210 wherein the outer surface of the metal bands 210 are substantially planar with the outer surface, preferably in the recessed portion, of the feed drum 202, the functionality of which was described above in reference to the setting of the stripper plate 116 relative to the feed drum 202.

Regarding the feed drum 202, it is preferably provided with a plurality of radial aligned suction openings 216 arranged in rows. The outer surface of the feed drum 202 is preferably coated with a material suitable for gripping sheets of paper such as mearthane. The outer surface of the feed drum 202 is mounted in manner so as to be spaced from the lower vertex 117 of the stripper plate 116 by a thickness corresponding to the individual thickness of the sheets. Additionally it is to be appreciated, as will be further discussed below, when feeder 100 is in use, the feed drum 202 is continuously rotating in a clockwise direction relative to the stripper blade 116. Preferably, the feed drum 202 rotates at a speed sufficient to feed at least twenty (20) sheets a second from a sheet stack disposed on the deck 106 of feeder 100.

Figure 10:
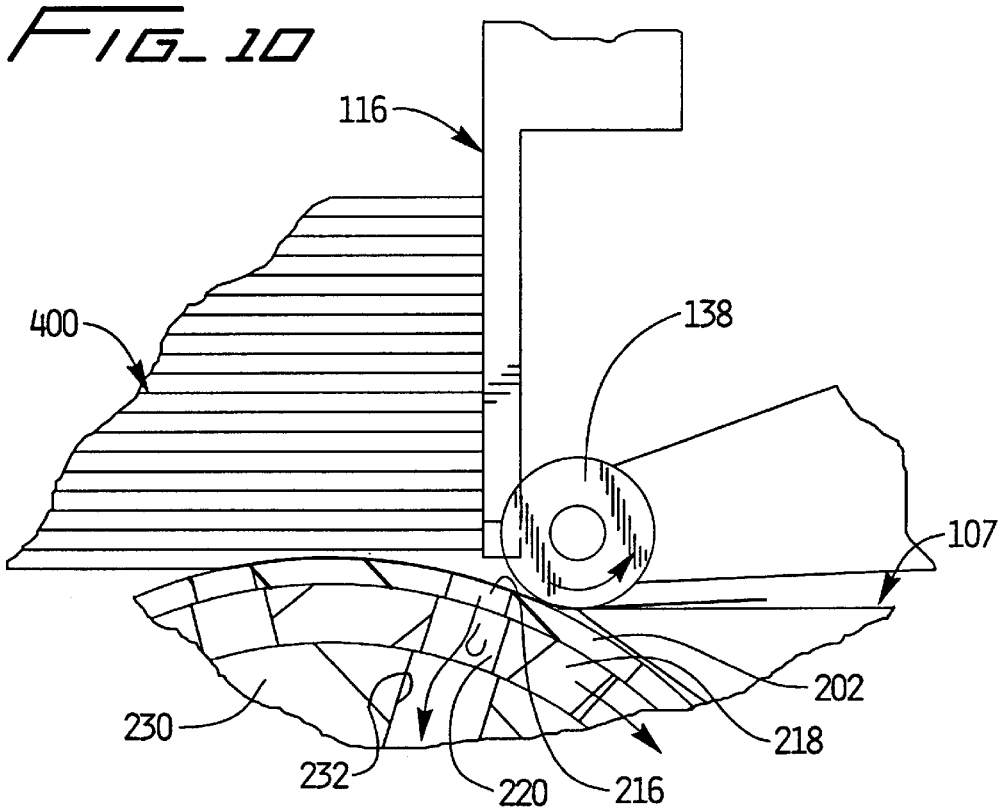

Slideably received within the feed drum 202 is a hollowed cylindrical vacuum drum vane 218. The vacuum drum vane 218 is fixedly mounted relative to the feed drum 202 and is provided with a elongate cutout 220 formed along its longitudinal axis. The drum vane 218 is fixedly mounted such that its elongate cutout 220 faces the suction openings 116 provided on the feed drum 202 preferably at a region below the lower vertex 117 of the stripper blade 116 (FIG. 5) so as to draw air downward (as indicated by arrow "c" in FIGS. 9 and 10) through the suction openings 216 when a vacuum is applied to the elongate cutout 220 as discussed further below. The vacuum drum vane 218 is adjustably (e.g., rotatable) relative to the outer drum 220 whereby the elongate cutout 220 is positionable relative to the suction openings 216 of the feed drum 202. To facilitate the aforesaid adjustablity of the drum vane 218, and with reference also to FIGS. 11 and 11*a,* an elongate vane adjuster 222 having a circular opening 226 at one of its ends is received about the circular end 224 of the drum vane 218. A key 228 is formed within the circular end 226 of the elongate vane adjuster, which receives within a corresponding key slot 230 formed in the end 224 of the drum vane 218 so as to prevent movement of the drum vane 218 when the vane adjuster 222 is held stationary. The vane adjuster 222 also is provided with a protrusion 223 extending from its side portion, which protrusion 223 is received within a guide slot 225 formed in a side portion 102 of the sheet feeder 100 for facilitating controlled movement of the vane adjuster 222 so as to adjust the drum vane 218.

Figure 11:
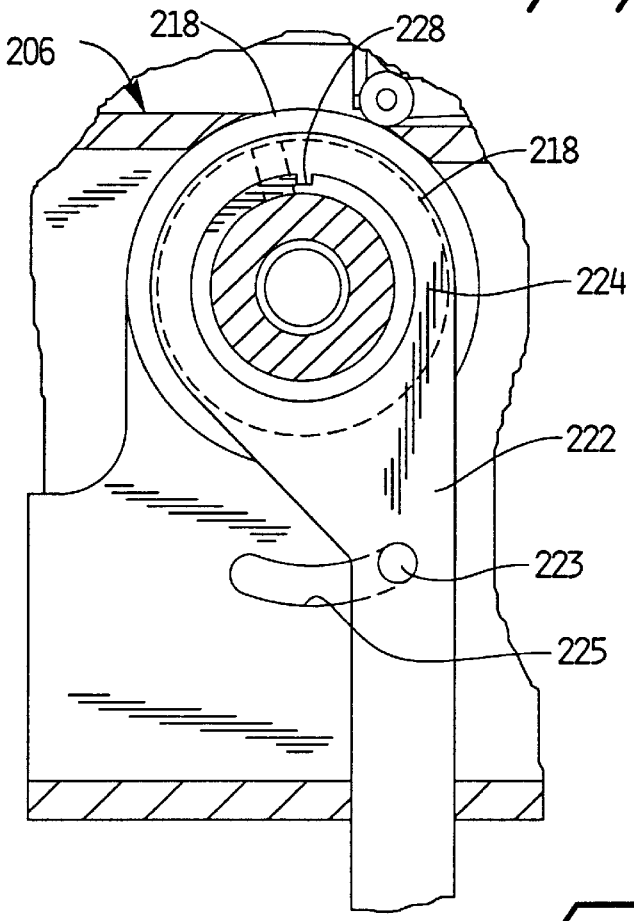
FIGS. 11 and 11*a* are partial enlarged sectional side views of the sheet feeder of FIG. 2 depicting the vane adjusting feature of the sheet feeder assembly.
Figure 11A:
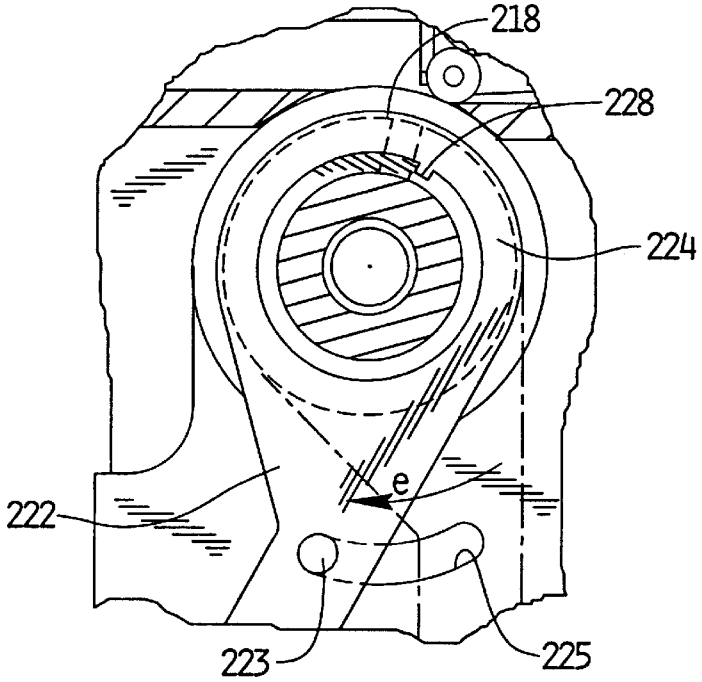

As best shown in FIGS. 11 and 11*a,* movement of the vane adjuster 222 affects corresponding rotational movement of the drum vane 218 so as to adjust the position of the elongate opening 220 relative to the suction openings 216 of the feed drum 202. Thus, when the vane adjuster 222 is caused to be moved along the direction of arrow "e" in FIG. 11*a,* the elongate opening 220 of the drum vane 218 rotates a corresponding distance. It is noted that when adjustment of the elongate cutout 220 of the drum vane 218 is not required, the vane adjuster 222 is held stationary in the sheet feeder 100 by any known locking means.

Slideably received within the fixed drum vane 218 is a hollowed valve drum 230, which is provided with an elongate cutout portion 232 along its outer surface. Valve drum 230 also has an open end 234. The valve drum 230 is mounted for rotation within the fixed drum vane 218, which controlled rotation is caused by its connection to an electric motor 214 mounted on a side portion 104 of the sheet feeder 100. Electric motor 214 is connected to the control system 14 of the inserter system 10, which control system 14 controls activation of the electric motor 214 in accordance with a "mail run job" as programmed in the control system 14 as will be further discussed below.

The open end 234 of the valve drum 230 is connected to an outside vacuum source (not shown), via vacuum hose 236, so as to draw air downward through the elongate opening 232 of the valve drum 230. It is to be appreciated that preferably a constant vacuum is being applied to the valve drum 230, via vacuum hose 236, such that when the valve drum 230 is rotated to have its elongate opening 232 in communication with the elongate opening 220 of the fixed drum vane 218 air is caused to be drawn downward through the suction openings 216 of the feed drum 202 and through the elongate openings 220, 232 of the fixed vane 218 and valve drum 230 (as indicated by arrows "c" in FIG. 4) and through the elongate opening 234 of the valve drum 230 (as indicated by arrows "d" in FIG. 4). As will be explained further below, this downward motion of air through the suction openings 216 facilitates the feeding of a sheet by the rotating feed drum 202 from the bottom of a stack of sheets disposed on the deck 106 of the feeder 100, which stack of sheets is disposed intermediate the two guide rails 108, 110. Of course when the valve drum 230 is caused to rotate such that its elongate cutout portion 232 breaks its communication with the elongate cutout 220 of the fixed vane 218, no air is caused to move downward through the suction openings 216 eventhough a constant vacuum is being applied to the valve drum 230.

With the structure of the sheet feeder 100 being discussed above, its method of operation will now be discussed. First, a stack of paper sheets is disposed on the feed deck 106 intermediate the two guide rails 108, 110 such that the leading edges of the sheets forming the stack apply against the stopping surface of the stripper plate 116 and that the spacing of the two guide rails 108, 110 from each other is adjusted to a distance corresponding, with a slight tolerance, to the width of the sheets. With compressed air being supplied to the spaced apart air nozzles 166 provided on each guide rail 108, 110, thin air cushions are formed between the lowermost sheets of the stack, through which the separation of the sheets from one another is facilitated and ensured.

Figure 7:
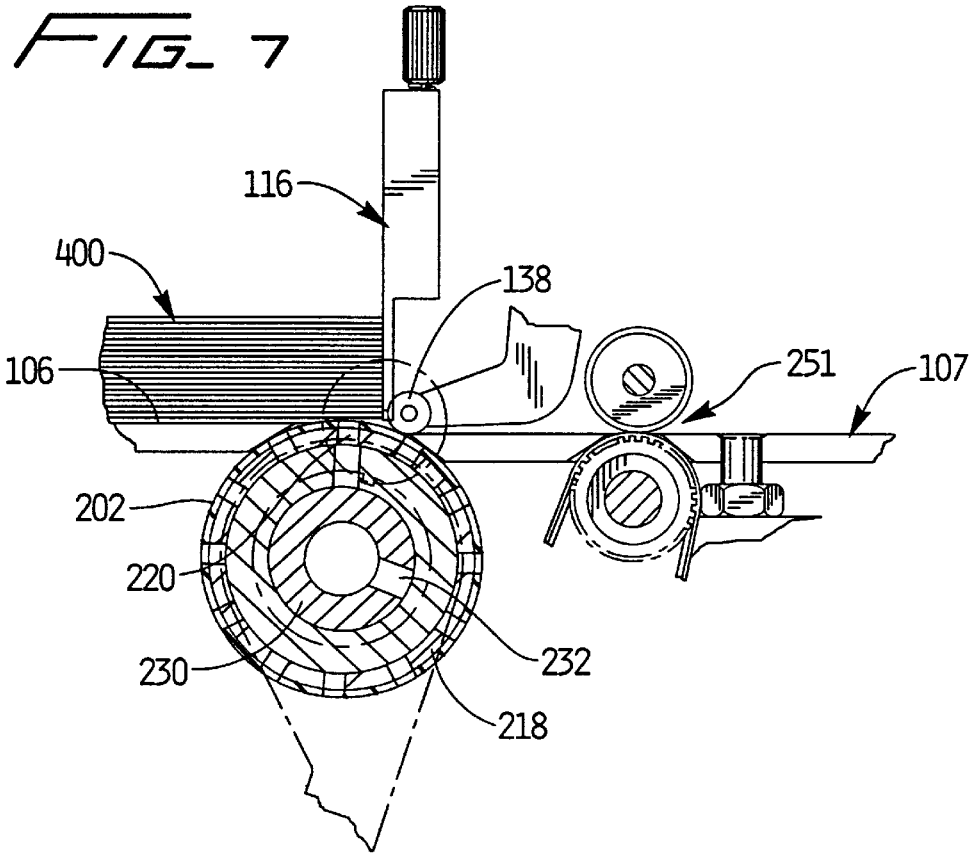
FIG. 7 is a partial side planar view, in partial cross-section, of the sheet feeder of FIG. 2 depicting the valve drum in its non-sheet feeding default position.

It is to be assumed that compressed air is constantly being supplied to the air nozzles 166 of the two guide rails 108, 110 and that the feed drum 202 and drive nip assembly 251 are constantly rotating, via motor 213, while a constant vacuum force is being applied to the valve drum 230, via vacuum hose 236. When in its default position, the valve drum 230 is maintained at a position such that its elongate cutout 232 is not in communication with the elongate cutout 220 of the drum vane 218 which is fixed relative to the constant rotating feed drum 202. Thus, as shown in FIGS. 7 and 8, no air is caused to flow downward through the cutout 220 of the drum vane 218, and in turn the suction openings 216 of the feed drum 202 eventhough a constant vacuum is applied within the valve drum 230. Therefore, eventhough the feed drum 202 is constantly rotating and the leading edges of the lowermost sheet of the stack 400 is biased against the feed drum 202, the feed drum 202 is unable to overcome the frictional forces placed upon the lowermost sheet by the stack 400 so as to advance this lowermost sheet from the stack 400. Therefore, when the valve drum 230 is positioned in its default position, no sheets are fed from the stack of sheets 400 disposed on the feed deck 106 of the sheet feeder 100.

With reference to FIG. 9, when it is desired to feed individual sheets from the feed deck 106, the valve drum 230 is rotated, via motor 213, such that the elongate cutout 232 of the valve drum 230 is in communication with the elongate cutout 220 of the drum vane 218 such that air is instantly caused to be drawn downward through the suction openings 216 on the rotating feed drum 202 and through the respective elongate cutouts 220, 232 provided on the fixed drum vane 218 and the valve drum 230. This downward motion of air on the surface of the rotating feed drum 202, beneath the lower vertex 117 of the stripper plate 116, creates a suction force which draws downward the leading edge of the lowermost sheet onto the feed drum 202. This leading edge adheres against the rotating feed drum 202 and is caused to separate and advance from the sheet stack 400, which leading edge is then caused to enter into the takeaway nips 138 (FIG. 10) and then into the positive drive nip assembly 251 such that the individual sheet is conveyed downstream from the sheet feeder 100. Thus, when the valve drum 230 is rotated to its actuated position (FIGS. 9 and 10) the lowermost sheet of the stack 400 is caused to adhere onto the rotating feed drum 202, convey underneath the lower vertex 117 of the stripper plate 116, into the takeaway nips 238 and then positive drive nip assembly 251, and past the sensor 160, so as to be individual feed from the sheet feeder 100 and preferably into a coupled downstream device, such as an accumulator 11 and/or folder 16. And as soon as the valve drum 230 is caused to be rotated to its default position (FIGS. 5 and 7), the feeding of sheets from the stack 400 is immediately ceased until once again the valve drum 230 is caused to be rotated to its actuated position (FIGS. 4 and 9).

It is to be appreciated that it is preferably the interaction between the sensor switch 160 with the control system 14 the enables the control of the sheet feeder 100. That is, when motor 214 is caused to be energized so as to rotate the valve drum 230 to its actuated position to facilitate the feeding of sheets, as mentioned above. Since the "mail run job" of the control system 14 knows the sheet collation number of every mailpiece to be processed by the inserter system 10, it is thus enabled to control the sheet feeder 100 to feed precisely the number of individual sheets for each collation corresponding to each mailpiece to be processed. For example, if each mailpiece is to consist of a two page collation count, the motor 214 is then caused to be energized, via control system 14, so as to rotate the valve drum to its actuated position (FIG. 9) for an amount of time to cause the feeding of two sheets from the sheet feeder 100, afterwhich the motor 214 is actuated again, via control system 14, so as to rotate the valve drum 230 to its default position (FIGS. 7 and 8) preventing the feeding of sheets. As stated above, the sensor switch 160 detects when sheets are fed from the sheet feeder 100, which detection is transmitted to the control system 14 to facilitate its control of the sheet feeder 100.

Of course the sheet collation number for each mailpiece can vary whereby a first mailpiece may consist of a two page collation while a succeeding mailpiece may consist of a four page collation. In such an instance, the control system 14 causes the valve drum 230 to be maintained in its actuated position (FIG. 9) for an amount of time to enable the feeding of two sheets immediately afterwards the control system 14 then causes the valve drum 230 to be maintained in its default position (FIGS. 7 and 8) for a predefined amount of time. After expiration of this predefined amount, the control system 14 causes to valve drum 230 to be again maintained in its actuated position for an amount of time to enable the feeding of four sheets, afterwhich the above process is repeated with respect to each succeeding sheet collation number for each succeeding mailpiece to be processed in the inserter system 10.

Figure 12:
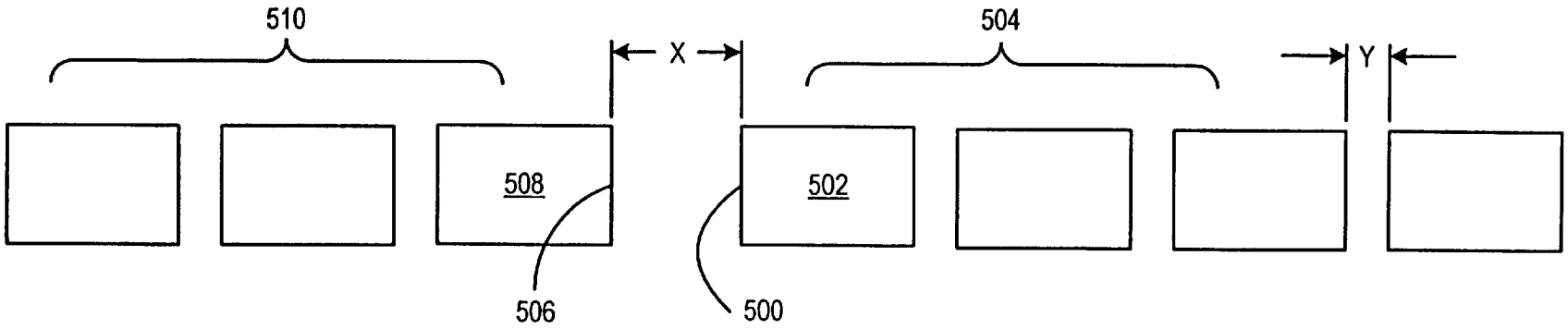
FIG. 12 is a sheet flow diagram illustrating the collation spacing provided by the sheet feeder of FIG. 1.

With reference to FIG. 12, it is noted that when the valve drum 230 is caused to be rotated and maintained in its default position (FIGS. 7 and 8), a predefined space (as indicated by arrow "x") is caused to be present between the trailing edge 500 of the last sheet 502 of a proceeding collation 504 and the lead edge 506 of the first sheet 508 of a succeeding collation 510. It is also noted that there is a predefined space (as indicated by arrow "y") between the trailing and leading edges of the sheets comprising each collation. It is to be appreciated that after the sheets are fed from the sheet feeder 100, they are then preferably conveyed to a downstream module for processing. An example of which is an accumulating station for accumulating the sheets collation so as to register their edges to enable further processing thereof, such as folding in a folding module 16. Therefore, the spacing between the trailing edge 500 of the last sheet 502 of a proceeding collation 504 and the lead edge 506 of the first sheet 508 of a succeeding collation 510 (as indicated by arrow "x") facilitates the operation of downstream module, such as an accumulating module 11, by providing it with sufficient time to enable the collection and processing of each collation of sheets fed from the sheet feeder 100 in seriatim.

In accordance with the above described preferred embodiment, and in order to preferably feed twenty sheets per second (20 sheets/second) from the sheet feeder 100, the valve drum 230 operates at a speed approximately equal to 23.26 revolutions/second, whereby a vacuum is then applied to the outside surface of the feed drum 202, via suction openings 216, and remains present for a predetermined amount of time sufficient to cause a predetermined amount of sheets to be fed. It is to be appreciated that the control system 14 of inserter system 10 preferably determines the period of time the valve drum 230 is to remain in its actuated position for the feeding of the predetermined number of sheets. For sheets fed in a common collation from the sheet feeder 100, the valve drum 230 is maintained in its actuated position until the last sheet of a collation is detected, via sensor switch 160. When this last sheet is detected, the valve drum 230, as controlled by the motor 214, will rotate to its default position. As mentioned above, this inter-collation motion profile exists to preferably provide the predefined spaces (e.g., gaps) between the trailing edge of a last sheet of a proceeding collation and the lead edge of a first sheet of a succeeding collation to provide the segregated processing of each respective collation in modules downstream of the sheet feeder 100 (e.g., an accumulator 11). In particular, the available time between collations (which of course is a function of the aforesaid predefined spaces between collations) is achieved by feeding each sheet of the collation at a period slightly faster than 0.050 second/sheet.

In summary, a sheet feeder having a high-speed pneumatic vacuum assembly for feeding sheets from a stack disposed on a feed deck has been described. Although the present invention has been described with emphasis on particular embodiments, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A sheet feeder for feeding individual sheets from a sheet stack, comprising:

a feed deck for supporting the sheet stack;

a pair of spaced apart parallel guide rails on the feed deck for receiving the sheet stack between the guide rails;

an elongate opening formed in the feed deck having an upstream and downstream end;

a feed drum rotatably mounted in the elongate opening of the feed deck such that a portion of its outer circumference extends above the feed deck and is provided with a recessed portion positioned such that fed sheets are caused to convey over the recessed portion of the rotating feed drum; and a stripper blade extending from a position above the feed deck and having a lower end portion spaced from the recessed portion of the feed drum at a distance substantially equal to a thickness of a sheet to be fed from the sheet stack.

2. A sheet feeder as recited in claim 1, wherein the lower end of the stripper blade is configured to have a substantially triangular configuration and the recessed portion of the feed drum is correspondingly configured to have a triangular configuration dimensioned to accommodate the lower triangular end of the stripper blade.

3. A sheet feeder as recited in claim 1, wherein the recessed portion of the feed drum is provided with a metal strip around the outer circumference of the feed drum.

4. A sheet feeder as recited in claim 1, wherein the feed drum is provided with a plurality grooved portions formed around the outer circumference of the feed drum and the downstream end of the elongate opening of the feed drum has a plurality of projections each extending towards, and partially within, each one of the plurality of grooved portions formed around the outer circumference of the feed drum.

5. A sheet feeder as recited in claim 1, wherein the upstream end of the elongate opening resides in a plane above the plane of the downstream end of the elongate opening.

6. A sheet feeder as recited in claim 1, wherein the feed drum includes a plurality of suction openings formed along its outer circumference and an inner vane cylinder having an outer and inner circumference with a vane cutout portion extending between its outer and inner circumference is received within the inner circumference of the feed drum such that the vane cutout portion is in communication with the suction openings extending above the planar surface of the feed deck.

7. A sheet feeder as recited in claim 1 wherein the feed drum further includes a rotating inner valve cylinder having an outer and inner circumference with a valve cutout portion extending between its outer and inner circumference, the valve cylinder is rotatably received within the inner vane drum, whereby when the valve cylinder is rotated such that its valve cutout portion is in communication with the vane cutout portion, and a vacuum is applied to the inner circumference of the valve cylinder, air is caused to be suctioned downward through the suction openings of the feed drum so as to cause a sheet on the bottom of the paper stack to adhere against the rotating feed drum and convey away from the sheet stack.

8. A sheet feeder for feeding individual sheets from a sheet stack, comprising:

a feed deck for supporting the sheet stack;

a pair of spaced apart parallel guide rails on the feed deck for receiving the sheet stack between the guide rails;

an elongate opening formed in the feed deck having an upstream and downstream end;

a feed drum having an inner and outer circumference and a plurality of suction openings extending between its outer and inner circumference and a plurality grooved portions formed around the outer circumference of the feed drum, the feed drum is rotatably mounted in the elongate opening of the feed deck such that a portion of its outer circumference extends above the feed deck and is provided with a recessed portion position such that fed sheets are caused to convey over the recessed portion of the rotating feed drum;

a vacuum source coupled to the inner circumference of the feed drum for drawing air downward from the plurality of suction openings sufficient to cause a sheet from the sheet stack to adhere against the rotating feed drum so as to cause the sheet to convey towards the downstream end of the elongate opening and feed away from the sheet stack;

a stripper blade extending from a position above the feed deck and having a lower end portion spaced from the recessed portion of the feed drum at a distance substantially equal to a thickness of a sheet to be fed from the sheet stack; and a plurality of projections extending from the downstream end of the elongate opening of the feed deck each extending towards, and partially within, each one of the plurality of grooved portions formed around the outer circumference of the feed drum for separating a fed sheet from its vacuum connection to the outer circumference of the feed drum as the fed sheet enters onto the downstream end of the elongate opening of the feed deck.

9. A sheet feeder as recited in claim 8 further including at least one rotatable roller biased against the feed drum in close proximity to the downstream end of the elongate opening of the feed deck for providing positive drive to a fed sheet after its vacuum connection to the feed drum has been terminated by the projections extending from the downstream end of the elongate opening of the feed deck.

10. A sheet feeder as recited in claim 8, wherein the lower end of the stripper blade is configured to have a substantially triangular configuration and the recessed portion of the feed drum is correspondingly configured to have a triangular configuration dimensioned to accommodate the lower triangular end of the stripper blade.

11. A sheet feeder as recited in claim 8, wherein the recessed portion of the feed drum is provided with a metal strip along the outer circumference of the feed drum.

12. A sheet feeder as recited in claim 8, wherein the upstream end of the elongate opening resides in a plane above the plane of the downstream end of the elongate opening.

13. A sheet feeder as recited in claim 8 further including an inner vane cylinder having an outer and inner circumference with a vane cutout portion extending between its outer and inner circumference wherein the inner vane cylinder is received within the inner circumference of the feed drum such that the vane cutout portion is in communication with the suction openings extending above the planar surface of the feed deck.

14. A sheet feeder as recited in claim 13 wherein the feed drum further includes a rotating inner valve cylinder having an outer and inner circumference with a valve cutout portion extending between its outer and inner circumference and is rotatably received within the inner vane drum, whereby when the valve cylinder is rotated such that its valve cutout portion is in communication with the vane cutout portion, and a vacuum is applied to the inner circumference of the valve cylinder, air is caused to be suctioned downward through the suction openings of the feed drum so as to cause a sheet on the bottom of the paper stack to adhere against the rotating feed drum and convey away from the sheet stack.

15. A sheet feeder for feeding individual sheets from a sheet stack, comprising:

a feed deck for supporting the sheet stack;

a pair of spaced apart parallel guide rails on the feed deck for receiving the sheet stack between the guide rails;

an elongate opening formed in the feed deck having an upstream and downstream end;

a feed drum having an inner and outer circumference, the feed drum is rotatably mounted in the elongate opening of the feed deck such that a portion of its outer circumference extends above the feed deck;

a mounting assembly pivotally supported above the feed deck and movable between an open and closed position, the mounting assembly including a stripper blade extending downward toward the feed deck such that when the mounting block is in its closed position a lower end portion of the stripper blade is spaced from the outer circumference of the feed drum at a distance substantially equal to a thickness of a sheet to be fed from the sheet stack and when positioned in its open position the lower end of the stripper blade is caused to pivot away from the feed deck such that the pivot path of the lower end of the stripper blade does not intersect with a plane in which the sheet stack resides on the feed deck; and at least one rotatable roller extending downward from the mounting block such the when the mounting assembly is positioned in its closed position the at lease one rotatable roller is caused to bias against the outer circumference of the feed drum in close proximity to the downstream end of the elongate opening of the feed deck.

16. A sheet feeder as recited in claim 15, wherein a portion of the outer circumference of the feed drum is provided with a substantially triangular configuration and the lower end of the stripper blade is configured to have a correspondingly configured triangular configuration dimensioned to partially receive within the triangular recess of the feed drum.

17. A sheet feeder as recited in claim 16, wherein the recessed portion of the feed drum is provided with a metal strip around the outer circumference of the feed drum.

18. A sheet feeder as recited in claim 15, wherein the feed drum is provided with a plurality grooved portions formed around it outer circumference and the downstream end of the elongate opening of the feed drum has a plurality of projections each extending towards, and partially within, each one of the plurality of grooved portions formed around the outer circumference of the feed drum.

19. A sheet feeder as recited in claim 15, wherein the upstream end of the elongate opening resides in a plane above the plane of the downstream end of the elongate opening.

20. A sheet feeder as recited in claim 15, wherein the feed drum is includes a plurality of suction openings formed along its outer circumference and the inner circumference of the feed drum is connected to a vacuum source for drawing air downward through the plurality of suction openings extending above the fed .

* * * * *